US005560235A

United States Patent [19]

Aucoin

[11] Patent Number: 5,560,235

[45] Date of Patent: Oct. 1, 1996

[54] LOCKABLE DOORKNOB ENCLOSURE

[76] Inventor: Rodrick P. Aucoin, 15555 George O'neal, Baton Rouge, La. 70817

[21] Appl. No.: 342,260

[22] Filed: Nov. 18, 1994

[51] Int. Cl.[6] ..... E05B 17/18

[52] U.S. Cl. ..... 70/455; 70/163; 70/168; 70/209; 70/232; 70/428

[58] Field of Search ..... 70/14, 19, 209, 70/229–232, 158–169, 178–180, 416, 417, 423, 424, 427, 428, 455

[56] References Cited

U.S. PATENT DOCUMENTS

| | | | |
|---|---|---|---|
| 200,599 | 2/1878 | Beachman | 70/158 |
| 2,169,438 | 8/1939 | Sherman | 70/163 X |
| 3,245,240 | 4/1966 | Deforrest | 70/209 |
| 3,623,346 | 11/1971 | Curtin | 70/424 |
| 3,636,742 | 1/1972 | Raney | 70/424 |
| 3,739,608 | 6/1973 | Young | 70/209 |
| 4,254,888 | 3/1981 | Chandler | 70/158 X |
| 4,561,273 | 12/1985 | Robinson | 70/209 X |
| 4,570,470 | 2/1986 | Gray, Sr. | 70/424 X |
| 4,838,059 | 6/1989 | Johnson | 70/209 |
| 5,033,280 | 7/1991 | Johnson | 70/178 X |

*Primary Examiner*—Steven N. Meyers
*Assistant Examiner*—Suzanne L. Dino
*Attorney, Agent, or Firm*—Joseph N. Breaux

[57] ABSTRACT

A lockable doorknob enclosure for use on doorknobs of the type having a knob attached to a shaft having a longitudinal axis. The lockable doorknob enclosure comprises: a containment structure having a sealable cavity for enclosing the doorknob and a portion of the shaft; an adjustable spacing mechanism; and a locking mechanism. The containment structure includes first and second pivoting structures which are preferably connected by a hinge. The first and second pivoting structures form a containment cavity of a size sufficient to receive therein the doorknob and a portion of the shaft when the pivoting structures are pivoted into a first, or closed, position. The containment structure has an aperture therethrough of dimensions sufficient to allow the shaft to be installed through the aperture when the first and second pivoting structures are pivoted into a second, or open, position. The adjustable spacing mechanism is located within the containment cavity and is positionable between the door knob and the aperture in a manner such that movement of the doorknob is restricted in a direction along the longitudinal axis of the shaft. An exterior portion of at least one of the first and second pivoting structures preferably includes a padded surface extending therefrom.

6 Claims, 3 Drawing Sheets

LOCKABLE DOORKNOB ENCLOSURE

TECHNICAL FIELD

The present invention relates to devices for preventing access to doorknob type entryway locks and more particularly to devices for preventing access to doorknob type entryway locks that include an adjustable doorknob spacing mechanism.

BACKGROUND ART

In situations where it is required to deny access to a building and the person to whom access is denied may possess a key to the door lock, it is desirable to have a secondary locking system in order to prevent access into the building. There are various ways of accomplishing this. One method of addressing this problem is with a lockable enclosure that is placed over the existing door knob. A problem with existing lockable doorknob enclosures is they do not deny access to the shaft of the door knob assembly. Access to the shaft allows a locking type wrench to be locked onto the shaft and forcibly rotated, unlocking the locking mechanism. It would be desirable, therefore, to have a lockable doorknob enclosure which completely covers the exposed shaft of the doorknob assembly. It would also be desirable to have a lockable doorknob enclosure that had additional storage space for a key.

GENERAL SUMMARY DISCUSSION OF INVENTION

It is thus an object of the invention to provide a lockable doorknob enclosure that is easy to use.

It is a further object of the invention to provide a lockable doorknob enclosure that prevents access to the shaft portion of a doorknob.

It is a still further object of the invention to provide a lockable doorknob enclosure that includes space for storing a key.

It is a still further object of the invention to provide a lockable doorknob enclosure that includes a mechanism for preventing damage to door surfaces.

Accordingly, a lockable doorknob enclosure for use on doorknobs of the type having a knob attached to a shaft having a longitudinal axis is provided. The lockable doorknob enclosure comprises: a containment structure having a sealable cavity for enclosing the doorknob and a portion of the shaft; an adjustable spacing mechanism; and a locking mechanism.

The containment structure includes first and second pivoting structures which are preferably constructed from eighth inch (⅛") steel and connected by a hinge. The preferred location of the hinge connections to the first and second pivoting structures will depend on the design of the door upon which the doorknob assembly is installed. The first and second pivoting structures form a containment cavity of a size sufficient to receive therein the doorknob and a portion of the shaft when the pivoting structures are pivoted into a first, or closed, position. The containment cavity is preferably of a size sufficient to allow a key or keys to be stored therein in addition to the doorknob and shaft portion.

The containment structure has an aperture therethrough of dimensions sufficient to allow the shaft to be installed through the aperture when the first and second pivoting structures are pivoted into a second, or open, position. The diameter of the aperture should be about one-sixteenth (1/32") to one-eighth (⅛") inch greater than the diameter of the shaft. In a preferred embodiment, the aperture is about one and three-sixteenths (1 3/16") inches in diameter. The first and second pivoting structures trap the shaft within the aperture when pivoted into the first position. An exterior portion of at least one of the first and second pivoting structures preferably includes a padded surface extending therefrom. The padded surface contacts the surface of the door when the enclosure is in use and prevents or minimizes damage to the surface of the door caused by contact with the containment structure.

The adjustable spacing mechanism is located within the containment cavity and is positionable between the door knob and the aperture in a manner such that movement of the doorknob is restricted in a direction along the longitudinal axis of the shaft. This restricted movement allows the exterior of the containment structure to be positioned snugly against either the door or the guard plate and, thus, denies individuals access to the shaft. Denying access to the shaft precludes the use of a locking type wrench about the shaft and rotating the shaft with sufficient force to pop the locking mechanism open.

The locking mechanism includes first and second locking members. The first locking member is in connection with the first pivoting structure. The second locking member is in connection with the second pivoting structure. The locking mechanism is operable exteriorly of the containment cavity. When the first and second pivoting structures are in the first position and the locking mechanism is operated, the first and second locking members engage and lock the first and second pivoting structures into the first, or closed, position. Although any locking mechanism which is operable exteriorly of the containment cavity is sufficient to practice the invention, the locking mechanism preferably includes a keyed lock having a key-way located on the exterior of the containment structure.

In a preferred embodiment, the spacing mechanism includes furcations between which the shaft may be positioned. The spacing mechanism may also include a first L-shaped member rigidly connected to one of the first and second pivoting structures which connects the spacing mechanism to the containment structure.

In another preferred embodiment, the first L-shaped member includes a first aperture; the securing mechanism further includes a second L-shaped member having an elongated aperture; and the securing means includes a member installed through the first and second elongated apertures.

In another preferred embodiment, the spacing mechanism includes a securing means for securing a portion of the spacing mechanism against the doorknob. The securing means is preferably actuated by a screw mechanism, and more preferably includes a portion, graspable between the fingers of a user, which allows the screw mechanism to be operated with the fingers alone.

In another embodiment, the locking mechanism includes a bar member in connection with the first pivoting structure and a locking member in connection with the second pivoting structure. The locking mechanism is operable exteriorly of the containment cavity in a manner such that the locking member may engage the bar member when the first and second pivoting structures are in the first position.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
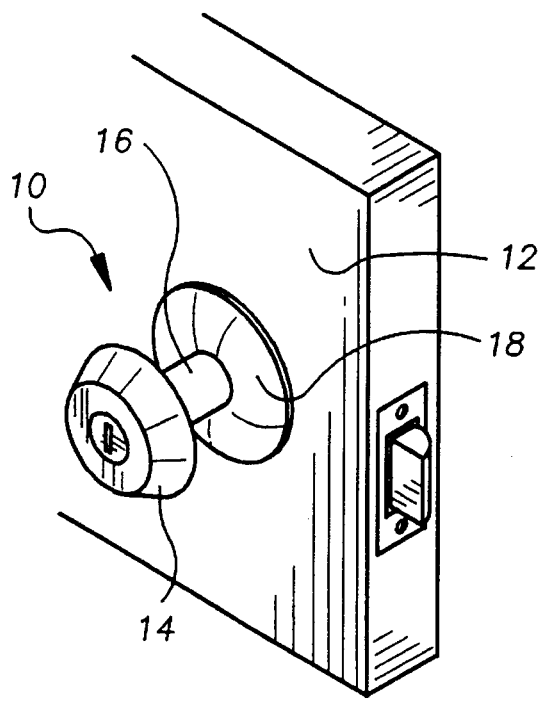
FIG. 1 is an isomeric view of a typical doorknob assembly installed on a representative door.

FIG. 1 shows a typical doorknob assembly 10 installed on a representative door 12. Doorknob assembly 10 includes a door knob 14, a shaft 16, and a guard plate 18.

Figure 2:
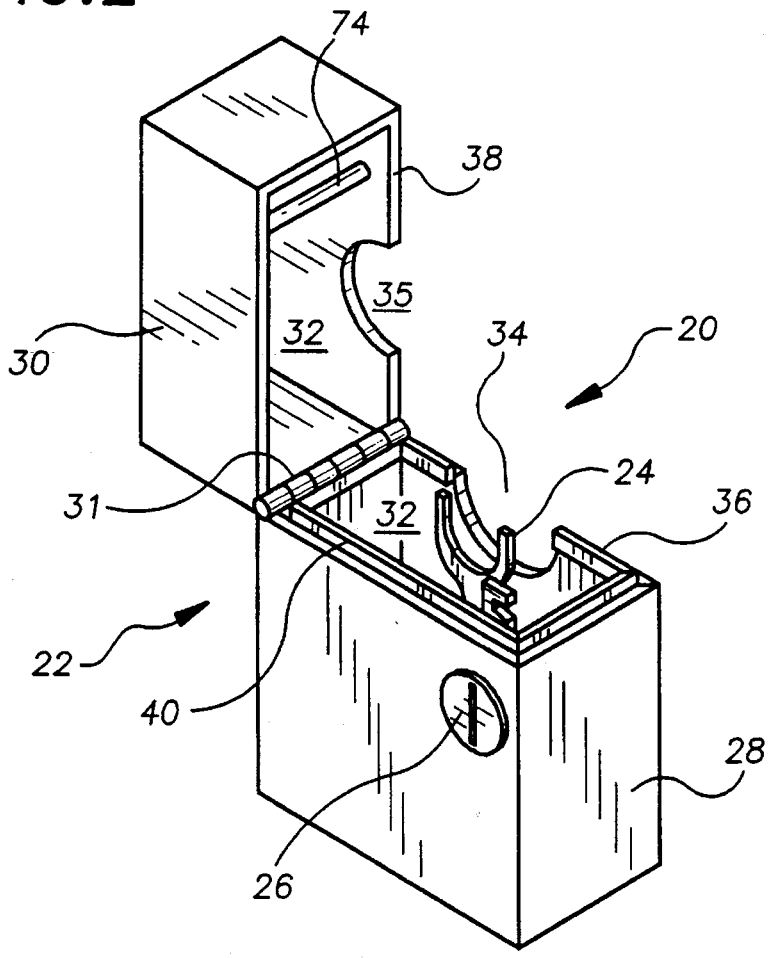
FIG. 2 is an isometric view of an exemplary embodiment of the lockable doorknob enclosure of the present invention.

FIG. 2 shows an exemplary embodiment of the lockable doorknob enclosure of the present invention, generally designated by the numeral 20. Lockable doorknob enclosure 20 includes: a containment structure 22, having a sealable cavity for enclosing the doorknob 14 and a portion of the shaft 16; an adjustable spacing mechanism 24; and a locking mechanism 26.

Containment structure 22 includes a first and second pivoting structure 28,30 connected by a hinge 31. The first and second pivoting structures 28,30 form a containment cavity 32 of a size sufficient to receive therein the doorknob and a portion of the shaft when pivoting structures 28,30 are pivoted into the closed position.

First pivoting structure 28 is a substantially rectangular shaped, 2½" wide by 3½" long by 4" deep, box that is open at one side. First pivoting structure 28 is constructed from about 3/32" steel sheeting. Second pivoting structure 30 is a substantially rectangular shaped, 2½" wide by 3½" long by 1½" deep, box that is open at one side. Second pivoting structure 30 is also constructed from about 3/32" steel sheeting. Use of a rectangularly shaped containment structure which has planar sides which abut the door jam reduces the possibility that the doorknob enclosure will be rotatable about the shaft when in use. In addition, the rectangular shape prevents the insertion of flat planar objects between the edge of the door and the door jam in an effort to defeat the locking mechanism of the doorknob. In this embodiment, first and second pivoting structures 28,30 are pivotally connected by hinge 31.

Each of the first and second pivoting structures 28,30 has a half-circular aperture 34,35 in connection with a portion of its perimeter 36,38 respectively. Each half circular aperture 34,35 has a radius of about six-tenths (6/10") of an inch. The half-circular apertures 34,35 are located in a manner such that, when first and second pivoting structures 28,30 are in the closed position, they are adjacent one another and form a circular aperture having a diameter of about one and one-fifth (1⅕") inches.

The perimeter 36 of first pivoting structure 28 includes a lipped portion 40 which fits within and adjacent to the perimeter 38 of second pivoting structure 30. Lipped portion 40 prevents thin flat objects from being placed between the two perimeters 36,38 when first and second pivoting structures 28,30 are in the closed position in an attempt to force the locking mechanism 26 open. Lipped portion 40 extends into second pivoting structure 30 about three-thirty-seconds (3/32") of an inch when first and second pivoting structures 28,30 are in the fully closed position.

Figure 3:
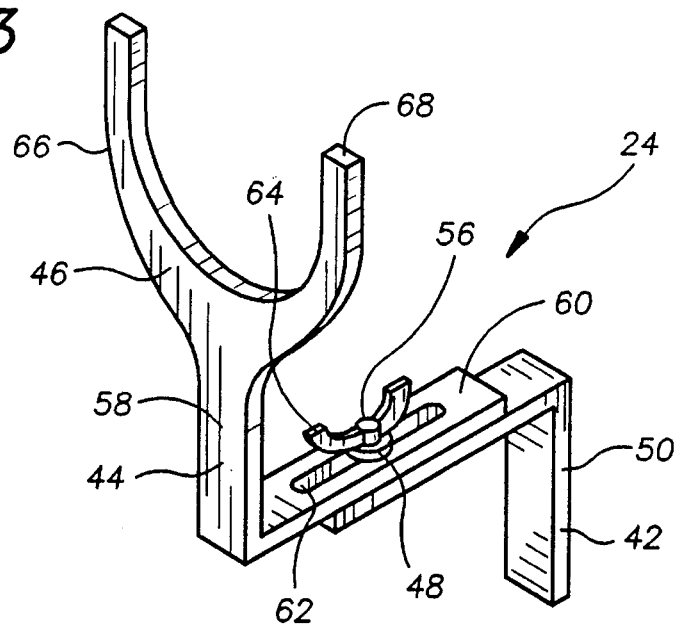
FIG. 3 is an isolated isometric view of the spacing mechanism.
Figure 4:
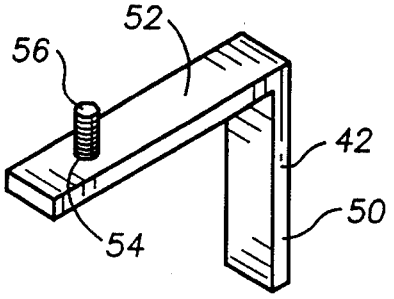
FIG. 4 is an isomeric view of the first L-shaped member of the spacing mechanism.

In this embodiment, adjustable spacing mechanism 24 is attached to first pivoting structure 28 and located within containment cavity 32. FIG. 3 is a view of the spacing mechanism 24 in isolation. Spacing mechanism 24 includes a first L-shaped member 42, a second L-shaped member 44, a furcated member 46, and a securing mechanism 48. First L-shaped member 42, shown in isolation in FIG. 4, is constructed of steel and includes a first leg 50 and a second leg 52. First leg 50 is welded to an interior wall of containment cavity 32 of first pivoting structure 28. Second leg 52 includes an aperture 54 through which a securing screw 56 is installed. Securing screw 56 is part of securing mechanism 48.

Again with reference to FIG. 3, second L-shaped member 44 includes a third leg 58 and a fourth leg 60. Furcated member 46 is integrally formed with third leg 58. Fourth leg 60 includes an elongated aperture 62 through which a section of securing screw 56 is installed. A wing nut 64 is threaded onto the end of securing screw 56. The distance between first leg 50 and third leg 58 is adjustable by the length of elongated aperture 62. The distance may be fixed by tightening wing nut 64.

Figure 5:
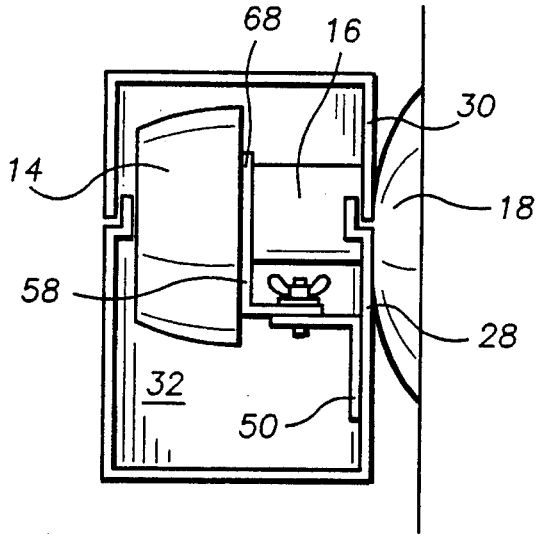
FIG. 5 is a cut-away view of the doorknob enclosure of FIG. 1 showing a doorknob installed within the enclosure.

Furcated member 46 includes two tines 66,68. The distance between tine 66 and tine 68 is about one and one-half (1½") inches. FIG. 5 is a cutaway view of doorknob enclosure 20 with a doorknob 14 and a section of shaft 16 within containment cavity 32. Shaft 16 is positioned between tines 66,68 of furcated member 46 and third leg 58 is positioned a distance away from first leg 50 a distance sufficient to force sidewalls of first and second pivoting structures 28,30 against guard plate 18.

Figure 6:
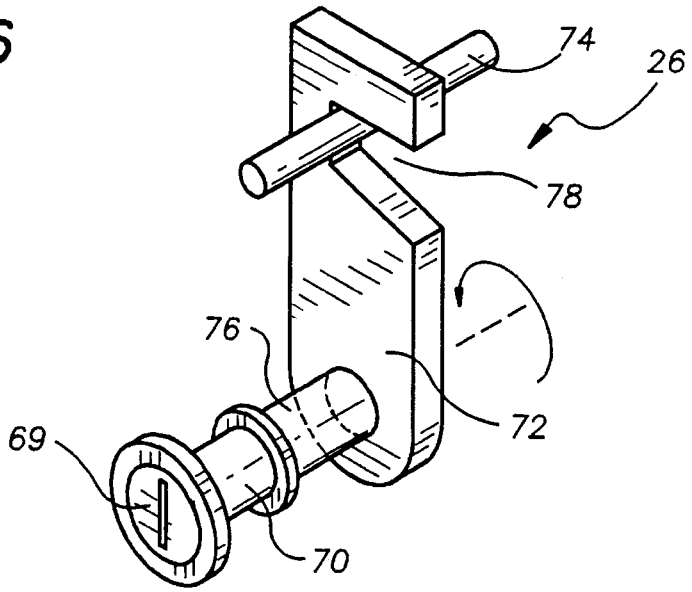
FIG. 6 is an isolated isometric view of the locking mechanism.

FIG. 6 shows locking mechanism 26 in isolation. Locking mechanism 26 includes a keyed lock 69, a lock shaft 70 including a first locking member 72, and a second locking member 74. First locking member 72 is attached to a rotatable shaft 76 and includes an engagement notch 78. When first and second pivoting structures 28,30 are in the closed position, first locking member 72 may be rotated into position in a manner such that engagement notch 78 engages second locking member 74. Second locking member 74 is a metal bar.

Figure 7:
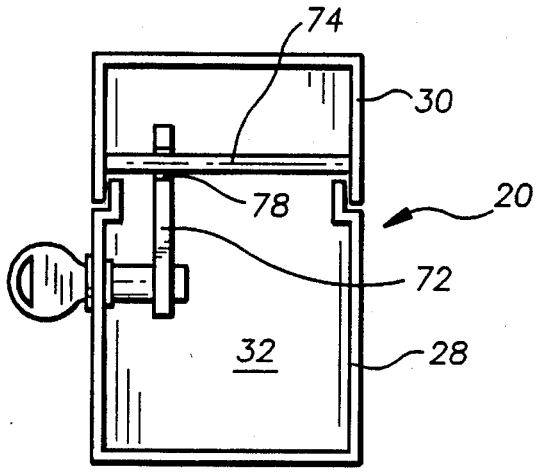
FIG. 7 is a cut-away view of the doorknob enclosure of FIG. 1 showing the locking mechanism of FIG. 6 installed within the doorknob enclosure.

FIG. 7 is a cutaway view of door knob enclosure 20 showing attachment of second locking member 74 within the containment cavity 32 of second pivoting structure 30. Also shown is engagement notch 78 of first locking member 72 in engagement with second locking member 74.

Figure 8:
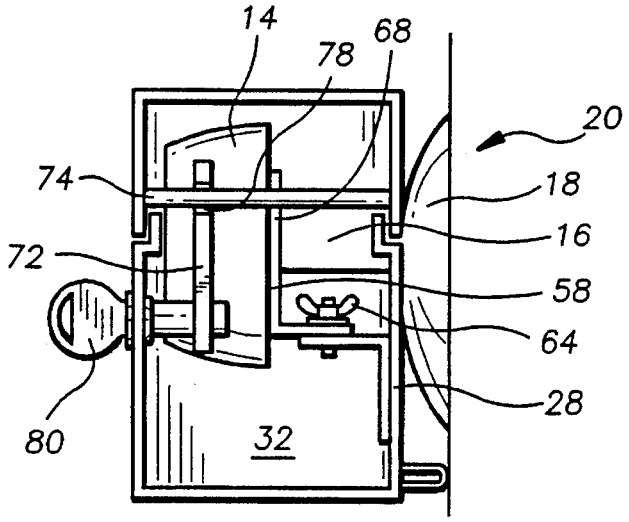
FIG. 8 is a cut-away view of the doorknob enclosure of FIG. 1 showing a doorknob and the locking mechanism of FIG. 6 installed within the doorknob enclosure.

FIG. 8 is a cutaway view of doorknob enclosure 20 with doorknob 14 and a section of shaft 16 within containment cavity 32 and second locking member 74 engaged within engagement notch 78 of first locking member 72.

Use of the doorknob enclosure is now described with reference to FIGS. 1, 2, 3 and 8. First and second pivoting structures 28,30 are positioned in the open position as shown in FIG. 1. First pivoting structure 28 is brought up under doorknob 14 and shaft 16 until shaft 16 is positioned within half circular aperture 34 and between tine 66 and tine 68 of furcated member 46. Third leg 58 is then forced in the direction toward doorknob 14 until the exterior of first pivoting structure 28 contacts guard plate 18. While maintaining third leg 58 in this position, first pivoting structure 28 is slipped off door knob 14 and shaft 16 and wing nut 64 is tightened. With third leg 58 thus secured, doorknob 14 and shaft 16 are placed back into the position previously described and first and second pivoting structures 28,30 are brought into the closed position. Once this is done, a key 80 is inserted into keyed lock 69 and first locking member 72 is rotated in a manner such that engagement notch 78 engages second locking member 74. Key 80 is then removed.

It can be seen from the preceding description that a method and device for preventing access to doorknob type entryway locks which easy to use, prevents access to the shaft portion of a doorknob, includes space for storing a key, and includes a mechanism for preventing damage to door surfaces has been provided.

It is noted that the embodiment of the lockable doorknob enclosure described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lockable doorknob enclosure for use on doorknobs of the type having a knob attached to a shaft having a longitudinal axis, said lockable doorknob enclosure comprising:

a containment structure having first and second pivoting structures which form a containment cavity able to receive therein said doorknob and a portion of said shaft when pivoted into a first position, said containment structure having an aperture therethrough able to allow said shaft to be installed therethrough when said first and second pivoting structures are pivoted into a second position, said first and second pivoting structures able to trap said shaft within said aperture when pivoted into said first position;

an adjustable spacing mechanism within said containment cavity positionable between said door knob and said aperture in a manner such that movement of said doorknob is restricted in a direction along said longitudinal axis of said shaft, said spacing mechanism including a securing means for securing a portion of said spacing mechanism against said doorknob, said spacing mechanism includes a first L-shaped member rigidly connected to one of said first and second pivoting structures and a second L-shaped member having an elongated aperture, said first L-shaped member including a first aperture, said second L-shaped member including furcations between which said shaft may be positioned, said securing means including a member installed through said first aperture and said elongated aperture; and a locking mechanism having a first locking member in connection with said first pivoting structure and a second locking member in connection with said second pivoting structure, said locking mechanism being operable exteriorly of said containment cavity in a manner such that said first and second locking members are engageable when said first and second pivoting structures are in said first position.

2. The lockable doorknob enclosure of claim 1, wherein:

said securing means is actuated by a screw mechanism.

3. The lockable doorknob enclosure of claim 2, wherein:

said screw mechanism includes a portion, graspable between the fingers of a user, which allows said screw mechanism to be operated with the fingers alone.

4. A lockable doorknob enclosure for use on doorknobs of the type having a knob attached to a shaft having a longitudinal axis, said lockable doorknob enclosure comprising:

a containment structure having first and second pivoting structures which form a containment cavity able to receive therein said doorknob and a portion of said shaft when pivoted into a first position, said containment structure having an aperture therethrough able to allow said shaft to be installed therethrough when said first and second pivoting structures are pivoted into a second position, said first and second pivoting structures able to trap said shaft within said aperture when pivoted into said first position;

an adjustable spacing mechanism within said containment cavity positionable between said door knob and said aperture in a manner such that movement of said doorknob is restricted in a direction along said longitudinal axis of said shaft, said spacing mechanism including a securing means for securing a portion of said spacing mechanism against said doorknob, said spacing mechanism includes a first L-shaped member rigidly connected to one of said first and second pivoting structures and a second L-shaped member having an elongated aperture, said first L-shaped member including a first aperture, said second L-shaped member including furcations between which said shaft may be positioned, said securing means including a member installed through said first aperture and said elongated aperture; and a locking mechanism having a bar member in connection with said first pivoting structure and a locking member in connection with said second pivoting structure, said locking mechanism being operable exteriorly of said containment cavity in a manner such that said locking member may engage said bar member when said first and second pivoting structures are in said first position.

5. The lockable doorknob enclosure of claim 4, wherein:

said securing means is actuated by a screw mechanism.

6. The lockable doorknob enclosure of claim 5, wherein:

said screw mechanism includes a portion, graspable between the fingers of a user, which allows said screw mechanism to be operated with the fingers alone.

* * * * *